US006564416B1

(12) United States Patent
Claire et al.

(10) Patent No.: US 6,564,416 B1
(45) Date of Patent: May 20, 2003

(54) TOOTHBRUSH

(75) Inventors: Karen Claire, Somerville, MA (US); Thomas Craig Masterman, San Francisco, CA (US); William A. Bredall, Pacifica, CA (US); James Schreck, Iowa City, IA (US)

(73) Assignee: Gillette Canada Company, Halafax (CA)

( * ) Notice: Subject to any disclaimer, the term of this patent is extended or adjusted under 35 U.S.C. 154(b) by 0 days.

(21) Appl. No.: 09/576,590

(22) Filed: May 22, 2000

(51) Int. Cl.[7] ..... A46B 9/04
(52) U.S. Cl. ..... 15/167.1; 15/172
(58) Field of Search ..... 15/167.1, 172; D4/104

(56) References Cited

U.S. PATENT DOCUMENTS

| | | | | |
|---|---|---|---|---|
| 800,422 | A | * | 9/1905 | White |
| 1,753,290 | A | | 4/1930 | Graves |
| 1,840,246 | A | | 1/1932 | Newman |
| 1,928,328 | A | * | 9/1933 | Carpenter |
| 2,242,743 | A | | 5/1941 | Brown |
| 2,273,278 | A | | 2/1942 | Chessborough et al. |
| 3,085,273 | A | | 4/1963 | Cowan |
| 3,722,020 | A | | 3/1973 | Hills |
| 4,010,509 | A | | 3/1977 | Huish |
| 4,081,876 | A | | 4/1978 | Pugh |
| 4,706,322 | A | | 11/1987 | Nicolas |
| 4,852,202 | A | | 8/1989 | Ledwitz |
| 5,046,213 | A | | 9/1991 | Curtis et al. |
| D329,946 | S | | 10/1992 | Curtis et al. |
| D329,947 | S | | 10/1992 | Curtis et al. |
| D330,286 | S | | 10/1992 | Curtis et al. |
| D334,288 | S | | 3/1993 | Witzig-Jaggi |
| 5,446,940 | A | | 9/1995 | Curtis et al. |
| D364,740 | S | | 12/1995 | Loew |
| D365,209 | S | | 12/1995 | Plummer |
| 5,622,502 | A | | 4/1997 | Wilkes et al. |
| 5,628,082 | A | | 5/1997 | Moskovich |
| 5,735,298 | A | | 4/1998 | Mayne et al. |
| 5,836,036 | A | * | 11/1998 | Ivory |
| 6,016,587 | A | * | 1/2000 | Savitt |
| 6,085,379 | A | * | 7/2000 | Stafford |

FOREIGN PATENT DOCUMENTS

| | | |
|---|---|---|
| CA | 454913 | 3/1949 |
| DE | 919 224 | 10/1954 |
| DE | 885 573 | 12/1998 |
| EP | 0894454 | 2/1999 |
| FR | 683.311 | 10/1929 |
| FR | 792476 | 12/1935 |
| FR | 2548528 | 1/1985 |
| NL | 324623 | 10/1957 |
| NL | 8500178 | 8/1986 |

* cited by examiner

*Primary Examiner*—Randall E. Chin
(74) *Attorney, Agent, or Firm*—David A. Howley

(57) ABSTRACT

A toothbrush includes a head having bristle tufts implanted therein. At least two of the tufts cross so as to permit at least some the bristles to intermingle. One of the two tufts is located adjacent a long side of the head.

33 Claims, 7 Drawing Sheets

TOOTHBRUSH

CROSS-REFERENCE TO RELATED APPLICATION(S)

Reference is made to commonly assigned application Ser. No. 09/064,545, entitled Toothbrush and filed on Apr. 22, 1998 in the names of Castillo et al, now abandoned.

FIELD OF THE INVENTION

The invention relates generally to the field of oral care, and in particular to toothbrushes.

BACKGROUND OF THE INVENTION

Tooth brushing and flossing are fundamental steps in achieving good oral hygiene. The practice of flossing, unfortunately, has not met with widespread acceptance among the general populace even though it is acknowledged by the general populace that flossing is something that should be completed as part of good oral hygiene. Furthermore, even people who floss oftentimes do not perform adequate flossing in hard to reach areas of the mouth. Unfortunately, while most commercially available toothbrushes clean the outer buccal face of teeth adequately, they fail to provide improved cleaning of plaque and debris from the gingival margin, interproximal areas, lingual surfaces and other hard to reach areas of the mouth.

One reason that such toothbrushes do not adequately clean the interproximal region is that the tufts are not angled in a direction to optimize interproximal and subgingival penetration. As such, these tufts cannot extend far enough into the interproximal region. Another reason for poor interproximal penetration/cleaning is that the bristle/tuft density is too high: having a large number of bristles/tufts provides good surface cleaning but hinders the bristles from penetrating between teeth.

Some brushes have tufts of bristles which have angled tufts which either appear to cross when viewed head-on (see for example U.S. Pat. No. 4,706,322 (the '322 patent), incorporated herein by reference) or from the side (see for example U.S. Pat. No. 3,085,273 (the '273 patent), incorporated herein by reference) to provide better interproximal penetration. The crossing tufts of the '322 patent will more effectively penetrate between teeth when the brush is being moved up and down rather than back and forth. Likewise, the crossing tufts of the '273 patent will more effectively penetrate between teeth when the brush is being moved back and forth rather than up and down.

Some current toothbrush designs involve filament tufts angled away from the center line/long axis of the brush head (FIG. 7) and some current toothbrush designs involve tuft filaments angled along the center line of the brush (FIG. 8). When these toothbrushes are placed on or against the teeth, the filaments bend and are deflected away from the gumline area.

U.S. Pat. No. 4,570,282 discloses a toothbrush having bristle elements arranged in two banks. The free ends of the bristle elements in the first bank extend convergingly with the free ends of the bristle elements in the second bank to provide a V-shaped tooth receiving channel having an acute included angle of from about 10 to 55 degrees. The bristle elements in the banks which are closest together extend into contact with one another at the bristle tips to define a doublet of mutually supported bristle elements.

SUMMARY OF THE INVENTION

The present invention is directed to overcoming one or more of the problems set forth above. Briefly summarized, according to one aspect of the present invention, a toothbrush includes a head having bristle tufts implanted therein. At least two of the tufts cross so as to permit at least some the bristles to intermingle. One of the two tufts is located adjacent a long side of the head.

Another aspect of the present invention relates to a toothbrush comprising a head having at least 2 bristle tufts which have a compound crossing angle such that one of the tufts eclipses at least a portion of the bristles of the other tuft when (a) viewed from a side of the toothbrush, and (b) viewed from an end of the toothbrush.

Such a compound crossing angle allows the tufts to more effectively penetrate in between teeth both when the brush is being moved up and down, and, back and forth.

Another aspect of the present invention relates to a toothbrush having a head with at least 2 bristle tufts. The head has two portions which define an opening in an interior portion of the head such that water can flow through this opening.

Allowing water to flow through an opening in a central portion of the head facilitates removal of excess toothpaste and other debris, thus enhancing the cleanliness of the brush over time.

A still further aspect of the invention relates to a toothbrush having a head with bristle tufts implanted therein. At least two of the tufts cross so as to permit at least some of the bristles to intermingle. At least some of the intermingled bristles from one of the two tufts extends past the other tuft.

According to another aspect of the invention, a toothbrush includes a handle, a head extending from the handle and having a top surface, and a plurality of tufts of bristles projecting from the top surface of the head. The cumulative cross-sectional area of each of the bristles defining a first area. A plane intersects all of the bristles except the shortest bristle and is tangent to or intersects at least a portion the free end of the shortest bristle. A perimeter located in the plane connects an outer surface of all outer tufts, the area within the perimeter defining a second area. The ratio of the first area to the second area is between about 5% to about 20%.

The previous paragraph describes a brush having a relatively low density of bristles/tufts. The density needs to be high enough so that it will clean the exposed tooth surfaces and be acceptable to consumers, yet low enough so that at least some of the bristles can penetrate and clean between teeth.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

As used herein the term "intermingled tufts" means two tufts which cross so as to force at least some of the individual filaments from each tuft bundle to mingle with the filaments of the other.

As used herein the term "compound crossing angle" relates to toothbrush filament tufts which are positioned on a toothbrush head at oblique angles such that the tufts appear to cross (one tuft eclipses the other) when viewed from a side of the toothbrush and when viewed from an end of the toothbrush.

Figure 1:
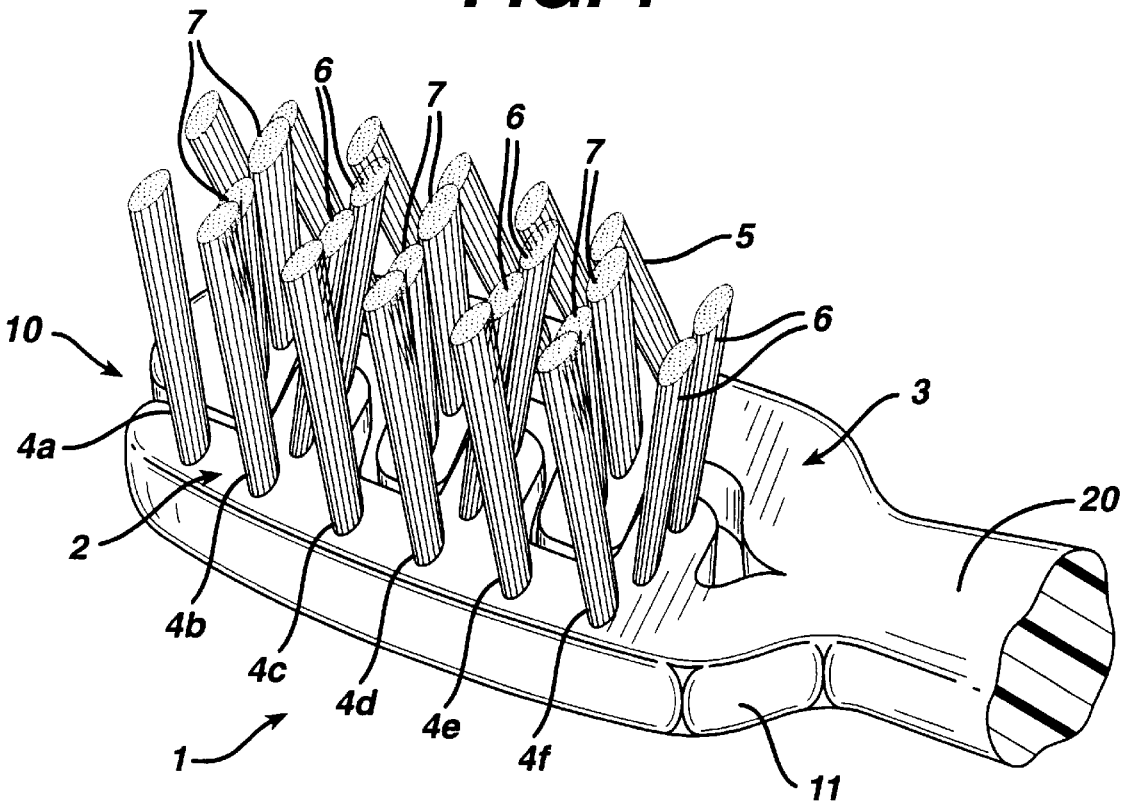
FIG. 1 is a perspective view of a preferred (split head) brush of the present invention.

Referring to FIG. 1, toothbrushes of the present invention are comprised of a handle 20 (shown partially in the figures) connected to a relatively planar head region 1. Head 1 has a maximum preferable width of about 0.45"–1.00", preferably 0.50"–0.80", and most preferably 0.51"–0.72". The head is comprised of two regions: a first region 2 and a second region 3. In a preferred embodiment of the present invention, the tufts are affixed to the first and second region as follows: The first region 2 is comprised of an outer row of tufts 4*a–f* which are inclined longitudinally toward the distal end of the head 10. The region is further comprised of two inner row of tufts 6 which are angled longitudinally toward the proximal end of the head 11. This results in a first region which appears to have tufts which cross when viewed from the side (see FIG. 3).

Next, the second region 3 is comprised of outer tufts 5 which are angled longitudinally toward the distal end of the head 10 and inner tufts 7 which are angled longitudinally towards the proximal end of the head 11. As such, tufts 6 and 7 of the inner rows alternate with each other along the length of the head. The result is a second region 3 which appears to have crossing tufts when viewed from the side. The free ends of tufts 4*a–f* are spaced from the free ends of tufts 5 by about 0" (touching)–0.60", preferably 0.05"–0.52", and most preferably 0.10"–0.42". The length of the tufts is about 0.26"–0.75", preferably 0.325"–0.60", and most preferably 0.35"–0.50". The angle A of the tufts along the length of the head (see FIG. 3) is about 0–30 degrees, preferably 5–25 degrees, and most preferably 10–25 degrees.

Figure 6:
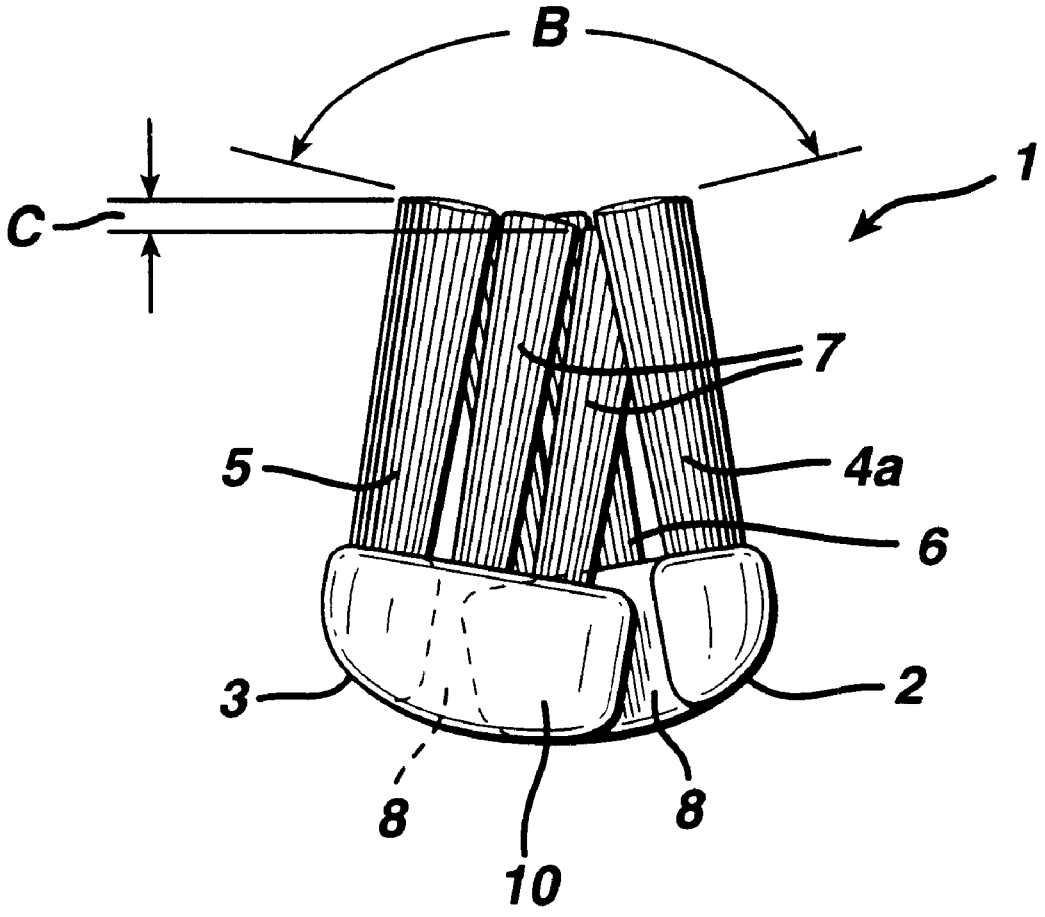
FIG. 6 is an end view of the brush of FIG. 1.
Figure 7:
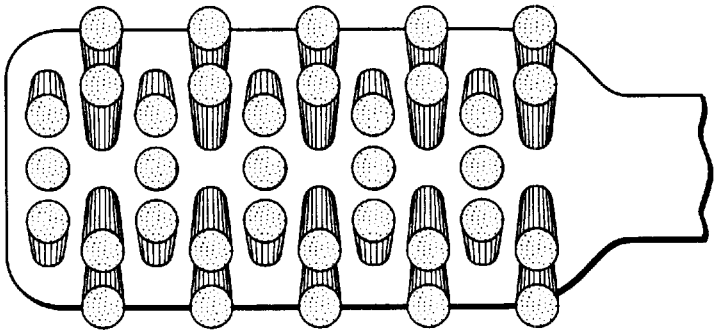
FIG. 7 PRIOR ART
FIG. 7 is a perspective view of a prior art brush with tufts angled away from the centerline of the brush (Colgate Total)
Figure 8:
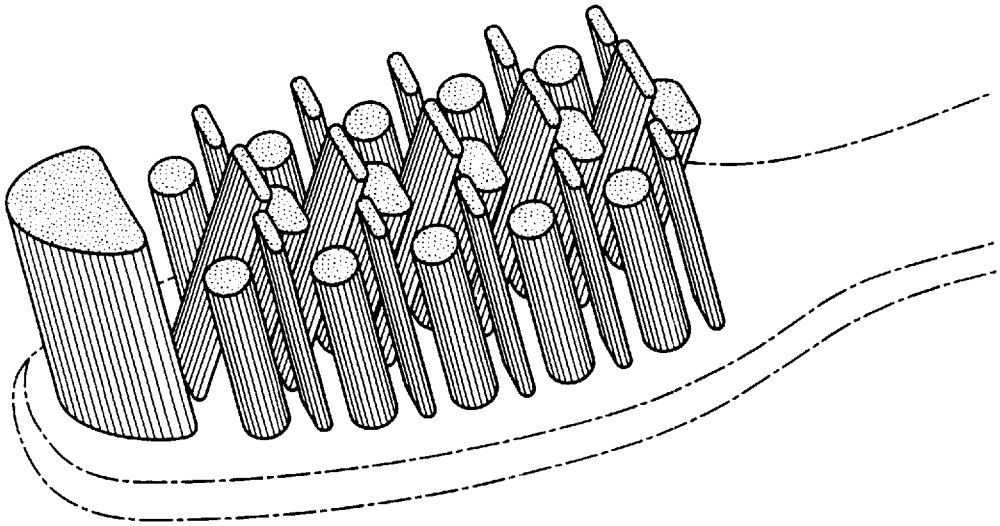
FIG. 8 PRIOR ART
FIG. 8 is a perspective view of a prior art brush with tufts angled along the centerline of the brush (Oral-B CrossAction).

As shown in FIG. 6, the two regions of the head 2 and 3 are angled transversely (i.e. tilt inwardly). As a result, the top surfaces of head portions 2 and 3 from which tufts project tilt inwardly such that the tufts tilt inwardly. Tufts which appear to cross from two directions can be on the same head region or on different head regions. The angle B between the regions is about 140–178 degrees, preferably 150–175 degrees, and most preferably 150–165 degrees. In this embodiment, the tufts appear perpendicular to their respective head region when viewed end on. A maximum depth C from the top of the "V" to the bottom of the "V" is about 0.03"–0.30", preferably 0.075"–0.25", and most preferably 0.10"–0.225".

Alternatively, head 1 can be a conventional head with a flat upper surface, and the tufts themselves can be tilted inward to give the same appearance (not shown in figures). In this embodiment, the tufts would not be perpendicular to the top surface of the head. Either embodiment results in tuft bundles which intermingle (see FIGS. 4 and 5 also).

Figure 2:
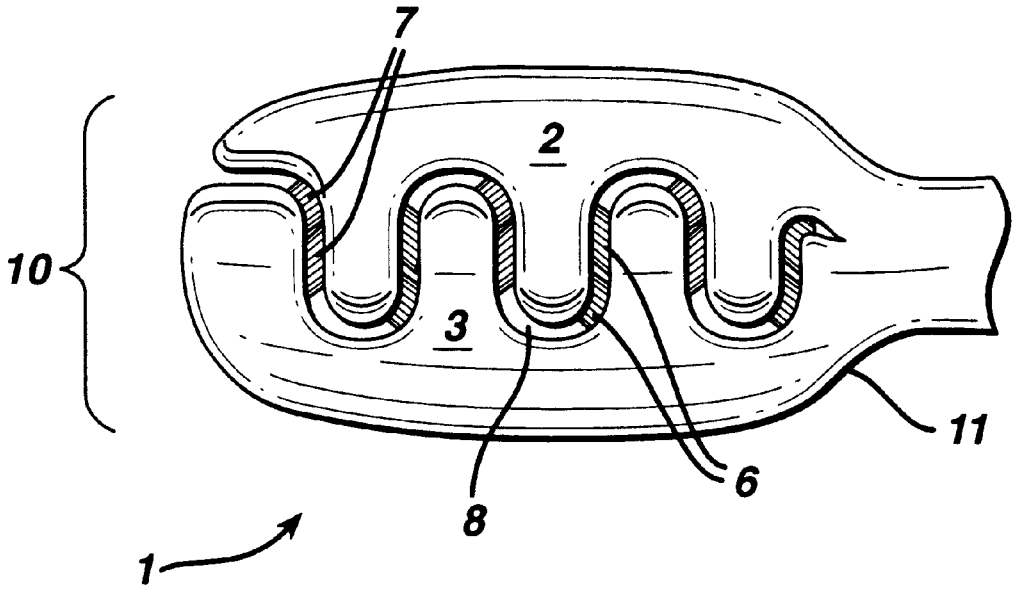
FIG. 2 is a bottom view of the brush of FIG. 1.

Bottom plan view FIG. 2 outlines a preferred configuration where the first region 2 and second region 3 form a complimentary relationship as defined by the corrugated space between the regions. Each region has alternating projections and spaces (recesses), the projections of one region engaging at least partially into the spaces of the other region. Regions (portions) 2 and 3 are movable independently of each other. An opening 8 is created between regions 2 and 3 in an interior portion of the head, and allows water to flow through the opening, thus facilitating rinsing of excess toothpaste, saliva and debris from the head. The area of opening 8 at a top surface of the head (see FIG. 4) is preferably between about 2% to about 20% of the total area (including the area of opening 8) of the top surface of the head, more preferably between about 4% to about 18%, even more preferably between about 6% to about 16%, and most preferably between about 8% to about 14%. Each projection preferably has one or more tufts and is surrounded on three sides by the other head portion.

However, the inventors also contemplate fabricating the brush according to this invention from a solid head with no central opening which is merely molded and tufted such that the bristles take on the geometric orientation as described above. As a further alternative, the central opening in the head is provided, but the two head portions are connected at the end of the head furthest from the handle. As such, relative movement of the head portions will be minimized.

Figure 3:
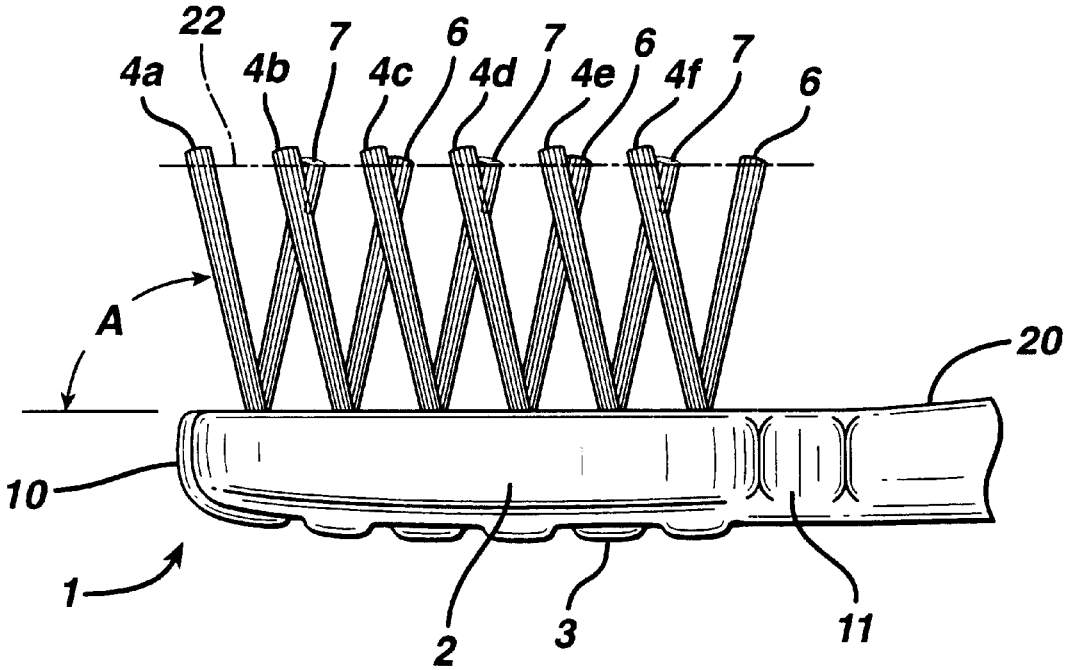
FIG. 3 is a side view of the brush of FIG. 1.
Figure 4:
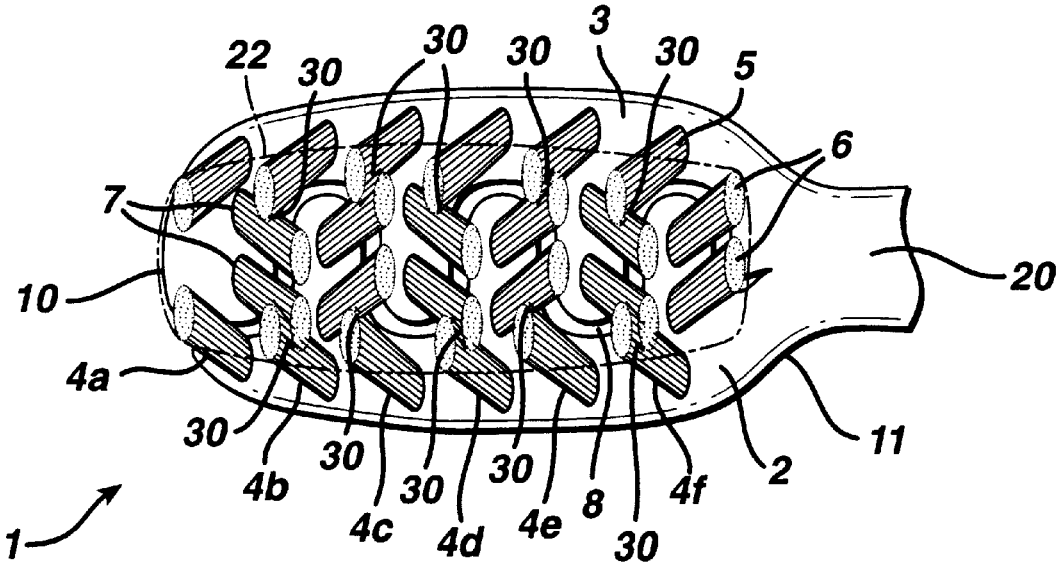
FIG. 4 is a top plan view of the brush of FIG. 1.

With reference to FIGS. 3 and 4, a cumulative cross-sectional area of each of the bristles on the head defines a first area. An imaginary perimeter 22 is shown. Perimeter 22 lies in a plane. This plane intersects all of the bristles except the shortest bristle and is tangent to or intersects at least a portion the free end of the shortest bristle. Perimeter 22 connects an outer surface of all outer tufts. The area within the perimeter defines a second area. The ratio of the first area to the second area is preferably between about 5% to about 20%. The ratio is more preferably between about 6% to about 18%, even more preferably between about 7% to about 16%, even more preferably between about 8% to about 14%, and most preferably between about 9% to about 12%. This ratio defines a bristle density for the brush.

The tuft bundles 4,5,6 and 7 preferably have rectangular shaped cross sections having a 1:2 to 1:6 length to width aspect ratio. More preferably, this aspect ration is from about 1:3 to 1:4. The inventors also contemplate the use of round, rectangular, square or any other shaped tuft bundles known to those skilled in the art. In the most preferred embodiment, the free ends of the individual filaments 20 are rounded into a dome-like shape. These are commonly referred to as end-rounded bristles.

Figure 5:
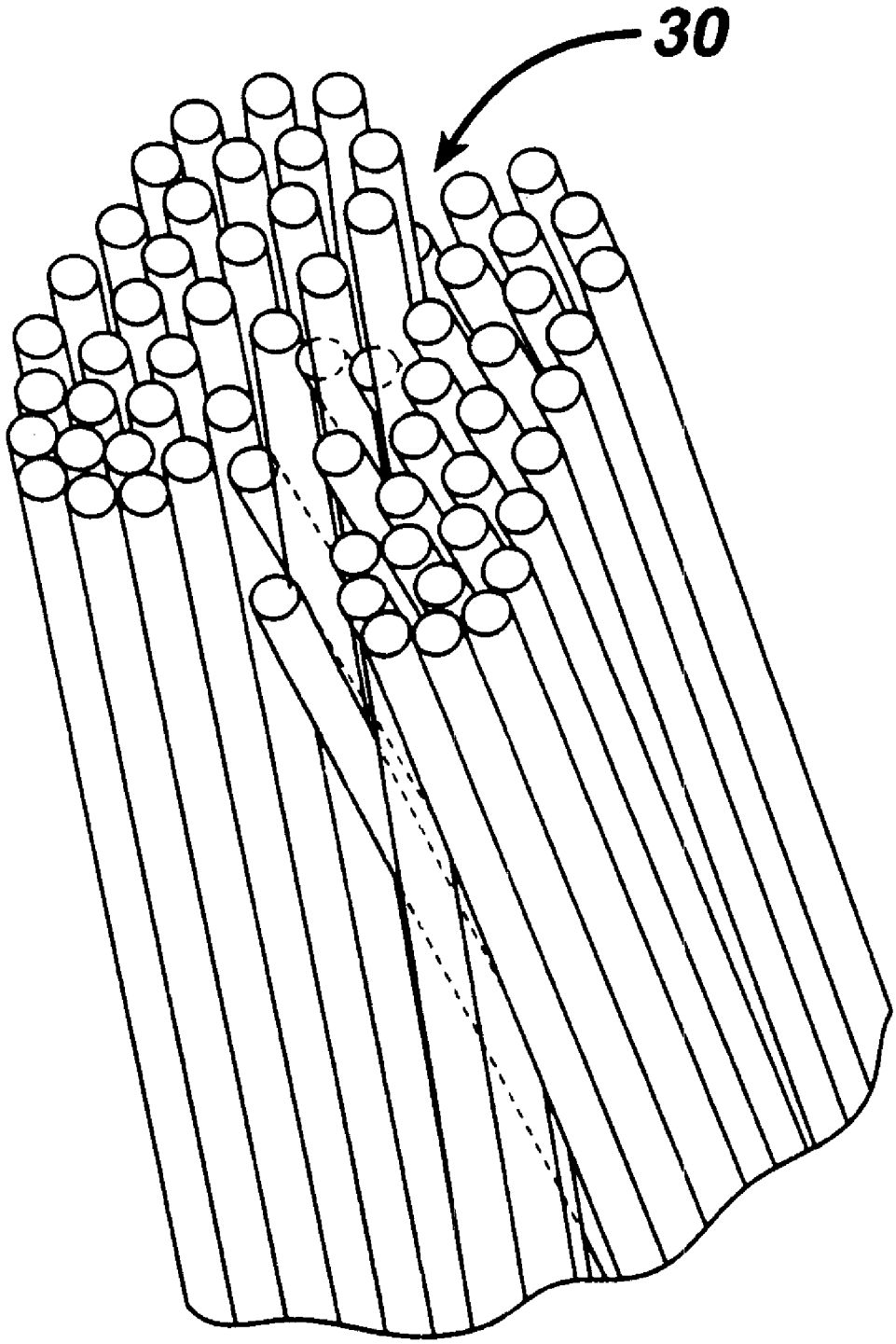
FIG. 5 is an enlarged view of the crossing tufts of the resent invention depicting the intermingled bristles.

FIG. 5 is an enlarged perspective view of two tufts which demonstrate the intermingled nature of these tufts. Region 30 is the region where the bristles are allowed to at least partially intermingle. This region could be done merely at the tips of the bristles (ie. inverted "v", not shown) or, as shown, forming a true crossing (ie. "x") pattern (see FIG. 3). Alternatively, region 30 could take on the appearance of an inverted "y" with bristles from a first tuft extending past a second tuft, but the bristles of the second tuft not extending past the first tuft (not shown). As shown in FIG. 4, one of the two tufts 4*b* which intermingle is located adjacent a long side of head 1.

The overlapping intermingled compound crossing angle pattern of the present invention promotes better interproximal and subgingival penetration. The tufts of the present invention are able to penetrate between the teeth, and to penetrate under the sulcus, both proximally and along the buccal gingival margin. In addition, it has been observed that the "3-dimensional" angling of tufts resulted in multiple tufts penetrating from different angles simultaneously.

In a most preferred embodiment, the brush head is fabricated from two parts relating to the first region 2 and the second region 3, which each have bristles angled in a pattern compound crossing angle. The two sides consist of intermingled overlapping tufts (see FIG. 5) which allow the two sides to be angled to come together in a unique V-shaped configuration (see FIG. 6). The angled tufts allow for a spacing and relative tuft angle/height configuration which is not manufacturable using current technology. The ability to have multiple tufts come together at an inward angle, with appropriate spacing, allows multiple tufts to engage interproximally and sub-gingivally simultaneously. Another added benefit of the split handle design is rinsability.

It may be possible to achieve similar results by manufacturing a first region and a second region on a brush head and subsequently bending the two regions relative to each other. It is thus possible to create a similarly acting tufting pattern on a single head with a bent head design, and possibly through the use of staple tufting technology. Additionally, the toothbrush can be made with a replaceable head feature.

A preferred manufacturing technique to produce the brushes of the present invention is to individually mold right and left sides of the brush, capturing the tufts of bristles in the head during molding (a hot tufting process). These two sides are then placed relative to each other and secured together by melting or gluing.

What is claimed is:

1. A toothbrush comprising a head having tufts of bristles implanted therein, wherein at least two tufts cross so as to permit at least some of the bristles in these two tufts to intermingle, wherein one of the two tufts is located adjacent a long side of the head, wherein the head includes two portions which are movable independently of each other.

2. The toothbrush of claim 1, wherein one of the two tufts is located on one of the two head portions, and the other of the two tufts is located on the other of the two head portions.

3. The toothbrush of claim 1, wherein both of the two tufts are located on the same head portion.

4. The toothbrush of claim 1, wherein the two portions of the head define an opening in a central portion of the head such that water can flow through this opening.

5. The toothbrush of claim 4, wherein a top surface of the other of the head portions from which tufts project is tilted inwardly such that its tufts tilt inwardly.

6. The toothbrush of claim 1, wherein each head portion includes alternating projections and recesses, the projections of each head portion fitting at least partially into the recesses of the other head portion.

7. The toothbrush of claim 1, wherein a top surface of one of the head portions from which tufts project tilt inwardly such that the tufts tilt inwardly.

8. The toothbrush of claim 7, wherein a top surface of the other of the head portions from which tufts project is tilted inwardly such that its tufts tilt inwardly.

9. A toothbrush comprising a head having at least 2 tufts of bristles which have a compound crossing angle such that one of the tufts eclipses at least a portion of the bristles of the other tuft when (a) viewed from a side of the toothbrush, and (b) viewed from an end of the toothbrush, wherein the head includes two portions which are movable independently of each other.

10. A toothbrush according to claim 9 wherein said head comprises adjacent, complementary first and second regions.

11. A toothbrush according to claim 10 wherein said adjacent portions are spaced apart so as to permit water to flow between them when the brush is rinsed during use.

12. The toothbrush of claim 9, wherein one of the two tufts is located on one of the two head portions, and the other of the two tufts is located on the other of the two head portions.

13. The toothbrush of claim 9, wherein both of the two tufts are located on the same head portion.

14. The toothbrush of claim 9, wherein the two portions of the head define an opening in a central portion of the head such that water can flow through this opening.

15. The toothbrush of claim 9, wherein each head portion includes alternating projections and recesses, the projections of each head portion fitting at least partially into the recesses of the other head portion.

16. The toothbrush of claim 9, wherein a top surface of one of the head portions from which tufts project is tilted inwardly such that its tufts tilt inwardly.

17. The toothbrush of claim 16, wherein a top surface of the other of the head portions from which tufts project is tilted inwardly such that its tufts tilt inwardly.

18. The toothbrush of claim 9, wherein the two tufts cross so as to permit at least some of the bristles to intermingle.

19. The toothbrush of claim 18, wherein at least some of the intermingled bristles from one of the two tufts extend past the other tuft.

20. The toothbrush of claim 19, wherein at least some of the intermingled bristles from each of the two tufts extends respectively past the other of the two tufts.

21. A toothbrush comprising a head having at least 2 bristle tufts, the head having two portions, wherein the two portions of the head define an opening therebetween, wherein each head portion includes one or more projections alternating with one or more recesses, the projections of each head portion fitting at least partially into the recesses of the other head portion, at least one of the projections being surrounded on three sides by the other head portion.

22. The toothbrush of claim 21, wherein the two head portions are movable independently of each other.

23. The toothbrush of claim 21, wherein one of the two tufts is located on one of the two head portions, and the other of the two tufts is located on the other of the two head portions.

24. The toothbrush of claim 21, wherein both of the two tufts. are located on the same head portion.

25. The toothbrush of claim 21, wherein at least one of the projections on one of the head portions has at least one tuft extending therefrom and is surrounded on three sides by the other head portion.

26. The toothbrush of claim 21, wherein a top surface of one of the head portions from which tufts project is tilted inwardly such that its tufts tilt inwardly.

27. The toothbrush of claim 21, wherein the area of the opening at a top surface of the head is between about 2% to about 20% of the total area, including the area of the opening, of the top surface of the head.

28. The toothbrush of claim 27, wherein the area of the opening at the top surface of the head is between about 4% to about 18% of the area of the top surface of the head.

29. The toothbrush of claim 27, wherein the area of the opening at the top surface of the head is between about 6% to about 16% of the area of the top surface of the head.

30. The toothbrush of claim 27, wherein the area of the opening at the top surface of the head is between about 8% to about 14% of the area of the top surface of the head.

31. The toothbrush of claim 21, wherein each projection is surrounded on three sides by the other head portion.

32. A toothbrush comprising a head having tufts of bristles implanted therein, wherein at least two tufts cross so as to permit at least some of the bristles in these two tufts to intermingle, at least some of the intermingled bristles from one of the two tufts extends past the other tuft, wherein the head includes two portions which are movable independently of each other.

33. The toothbrush of claim 32, wherein at least some of the intermingled bristles from each of the two tufts extends respectively past the other of the two tufts.

* * * * *